US008902132B2

(12) United States Patent
Ozawa et al.

(10) Patent No.: US 8,902,132 B2
(45) Date of Patent: Dec. 2, 2014

(54) SELF LIGHT EMISSION DISPLAY DEVICE, POWER CONSUMPTION DETECTING DEVICE, AND PROGRAM

(75) Inventors: Atsushi Ozawa, Kanagawa (JP); Mitsuru Tada, Kanagawa (JP)

(73) Assignee: Sony Corporation, Tokyo (JP)

( * ) Notice: Subject to any disclaimer, the term of this patent is extended or adjusted under 35 U.S.C. 154(b) by 1873 days.

(21) Appl. No.: 11/607,008

(22) Filed: Dec. 1, 2006

(65) Prior Publication Data

US 2007/0139406 A1 Jun. 21, 2007

(30) Foreign Application Priority Data

Dec. 5, 2005 (JP) ..... 2005-350116

(51) Int. Cl.

*G09G 3/30* (2006.01)
*G09G 3/32* (2006.01)
*G09G 3/20* (2006.01)

(52) U.S. Cl.

CPC ..... *G09G 3/3233* (2013.01); *G09G 2360/16* (2013.01); *G09G 2330/021* (2013.01); *G09G 2360/18* (2013.01); *G09G 2300/0861* (2013.01); *G09G 3/2092* (2013.01)

USPC ..... 345/76; 345/52; 345/211; 345/204; 345/690; 345/212; 345/77; 345/78; 345/80; 345/82; 315/169.3

(58) Field of Classification Search

USPC ..... 345/76, 204, 77

See application file for complete search history.

(56) References Cited

U.S. PATENT DOCUMENTS

| | | | | |
|---|---|---|---|---|
| 4,203,103 | A * | 5/1980 | Osada et al. | 345/38 |
| 5,745,085 | A * | 4/1998 | Tomio et al. | 345/63 |
| 6,549,867 | B1 * | 4/2003 | Smith | 702/107 |
| 7,116,059 | B2 * | 10/2006 | Hori et al. | 315/169.3 |
| 7,330,172 | B2 * | 2/2008 | Itoh et al. | 345/102 |
| 7,423,613 | B2 * | 9/2008 | Joo et al. | 345/60 |
| 7,460,137 | B2 * | 12/2008 | Miyagawa | 345/690 |
| 7,505,026 | B2 * | 3/2009 | Baba et al. | 345/102 |
| 7,592,974 | B2 * | 9/2009 | Suzuki et al. | 345/60 |
| 8,514,216 | B2 * | 8/2013 | Tada et al. | 345/212 |

(Continued)

FOREIGN PATENT DOCUMENTS

| | | |
|---|---|---|
| JP | 2000-187466 A | 7/2000 |
| JP | 2001-022318 A | 1/2001 |

(Continued)

OTHER PUBLICATIONS

Japanese Office Action issued Aug. 9, 2011 for corresponding Japanese Application No. 2005-350116.

(Continued)

*Primary Examiner* — Grant Sitta

(74) *Attorney, Agent, or Firm* — Rader, Fishman & Grauer PLLC

(57) ABSTRACT

Disclosed herein is a self light emission display device includes a buffer memory configured to delay the supply of pixel data to a self light emission panel, a lookup table configured to store all gradation values corresponding to a variable range of the pixel data and electric power values to be consumed for light emission respectively at the gradation values, in association with each other, and a power consumption calculator configured to add respective power consumption values of all pixels of a frame which are determined by referring to said lookup table to calculate a power consumption value of the frame.

17 Claims, 12 Drawing Sheets

(56) References Cited

U.S. PATENT DOCUMENTS

| | | | | |
|---|---|---|---|---|
| 2004/0158752 | A1* | 8/2004 | Borza et al. | 713/320 |
| 2005/0184975 | A1* | 8/2005 | Sawada | 345/204 |
| 2005/0264492 | A1* | 12/2005 | Knapp et al. | 345/76 |
| 2006/0022915 | A1* | 2/2006 | Weitbruch et al. | 345/77 |
| 2006/0244699 | A1* | 11/2006 | Yamazaki | 345/82 |

FOREIGN PATENT DOCUMENTS

| | | | |
|---|---|---|---|
| JP | 2001-222253 | A | 8/2001 |
| JP | 2002-041188 | A | 2/2002 |
| JP | 2003-329714 | A | 11/2003 |
| JP | 2005-266735 | A | 9/2005 |
| JP | 2005-275048 | A | 10/2005 |

OTHER PUBLICATIONS

Japanese Office Action issued May 8, 2012 for corresponding Japanese Application No. 2005-350116.

* cited by examiner

| GRADATION | CONVERSION | PIXEL POWER CONSUMPTION |
|---|---|---|
| 0 | ⇔ | $P_0$ |
| 1 | ⇔ | $P_1$ |
| • • • | ⇔ | • • • |
| 254 | ⇔ | $P_{254}$ |
| 255 | ⇔ | $P_{255}$ |

FIG. 5

| GRADATION | PIXEL POWER CONSUMPTION | POWER SUPPLY VOLTAGE | POWER CALCULATION |
|---|---|---|---|
| 0 | $P_0$ | Vcc | $P_0 = I_{d0} \times V_{cc}$ |
| 1 | $P_1$ | | $P_1 = I_{d1} \times V_{cc}$ |
| • • • | • • • | | • • • |
| 254 | $P_{254}$ | | $P_{254} = I_{d254} \times V_{cc}$ |
| 255 | $P_{255}$ | | $P_{255} = I_{d255} \times V_{cc}$ |

SELF LIGHT EMISSION DISPLAY DEVICE, POWER CONSUMPTION DETECTING DEVICE, AND PROGRAM

CROSS REFERENCES TO RELATED APPLICATIONS

The present invention contains subject matter related to Japanese Patent Application JP 2005-350116 filed in the Japanese Patent Office on Dec. 5, 2005, the entire contents of which being incorporated herein by reference.

BACKGROUND OF THE INVENTION

1. Field of the Invention

The present invention relates to the art of detecting the electric power consumed by a self light emission panel and, more particularly, to a self light emission display device, a power consumption detecting device, and a program.

2. Description of the Related Art

Flat panel displays have been used widely in computer display units, cellular phone sets, television receivers, and other electronic devices. At present, liquid crystal display panels are mainly used as flat panel displays. However, the liquid crystal display panels have been and are still suffering small angles of view and low response speeds.

The advent of flat panel display panels, which are free of the drawbacks of liquid crystal display panels has been expected.

The most promising one of those flat panel display panel is an organic EL display panel including a matrix of organic EL elements. The organic EL display panel not only has a good angle of view and responsiveness, but also provides other excellent characteristics including no need for backlight, high luminance, and high contrast.

It is also important for organic EL display panels to have a lower power consumption requirement than ever. Reduced power consumption as well as suppressing the bad effects that an abrupt load change has is a common task to be achieved among all self light emission devices. Such a task is considered to be indispensable for reducing the power consumption of all the device components and also for reducing the scale of the power supply system for the display panel.

Some established technologies for detecting the electric power consumed by an organic EL display panel will be described below.

Japanese Patent Laid-Open No. 2003-329714 discloses a circuit for reducing a power loss caused by a resistor that is used to detect a consumed current for thereby increasing the accuracy with which to detect power consumption.

Japanese Patent Laid-Open No. 2000-187466 discloses a circuit for detecting abnormal power consumption based on detected actual power consumption and an image display ratio calculated from image data.

Japanese Patent Laid-Open No. 2002-041188 reveals a power supply system for calculating power consumption using a measured current value and supplying the calculated power consumption data to a power supply circuit through a feedback loop to absorb power supply fluctuations.

SUMMARY OF THE INVENTION

These established arrangements share in common the detection of power consumption based on the actual detection of a current supplied from the power supply. The detecting process is proper in terms of power consumption.

However, if the detected power consumption is used for some processing or control, as with Japanese Patent Laid-Open No. 2002-041188, then there occurs a problem of a slow response from the detection of power consumption to the execution of the processing or control process.

The problem of a slow response cannot be solved even if the response gain is increased because the increased response gain is unable to change the basic concept that the processing or control process is started based on the actual detection of power consumption.

As disclosed in Japanese Patent Laid-Open No. 2003-329714, a power loss is necessarily caused by the detection of power consumption. When a small level of electric power is detected, it is necessary to take into account a detection error which may be caused.

It is desirable to provide a device for detecting an amount of electric power consumed by a self light emission device according to a fully digital process.

According to an embodiment of the present invention, there is provided a self light emission display device including a buffer memory for delaying the supply of pixel data to a self light emission panel, a lookup table for storing all gradation values corresponding to a variable range of the pixel data and electric power values to be consumed for light emission respectively at the gradation values, in association with each other, and a power consumption calculator for adding respective power consumption values of all pixels of a frame which are determined by referring to the lookup table to calculate a power consumption value of the frame.

According to an embodiment of the present invention, there is also provided a self light emission display device including a lookup table for storing all gradation values corresponding to a variable range of the pixel data and electric power values to be consumed for light emission respectively at the gradation values, in association with each other, and a power consumption calculator for adding respective power consumption values of all pixels of a frame which are determined by referring to the lookup table in each of preset blocks to calculate respective power consumption values of the blocks.

With the above arrangements, the power consumption of the self light emission device is detected directly from pixel data. Therefore, it is possible to detect the power consumption before an image is displayed based on the pixel data. The difference in time between the detection of power consumption and the display of the image may be used to solve the responsiveness problem and put the power consumption to secondary use.

BRIEF DESCRIPTION OF THE DRAWINGS

FIG. 5 is a diagram showing the principle of calculating power consumption values corresponding to gradation values;

DETAILED DESCRIPTION OF THE PREFERRED EMBODIMENTS

Self light emission display devices with a power consumption detecting function according to embodiments of the present invention will be described below.

It should be understood that parts and details that belong to and are neither shown nor described in the embodiments of the present invention are of known nature in the art.

The embodiments of the present invention which will be described below are shown by way of example only, and the present invention should not be limited to the illustrated embodiments.

Figure 1:
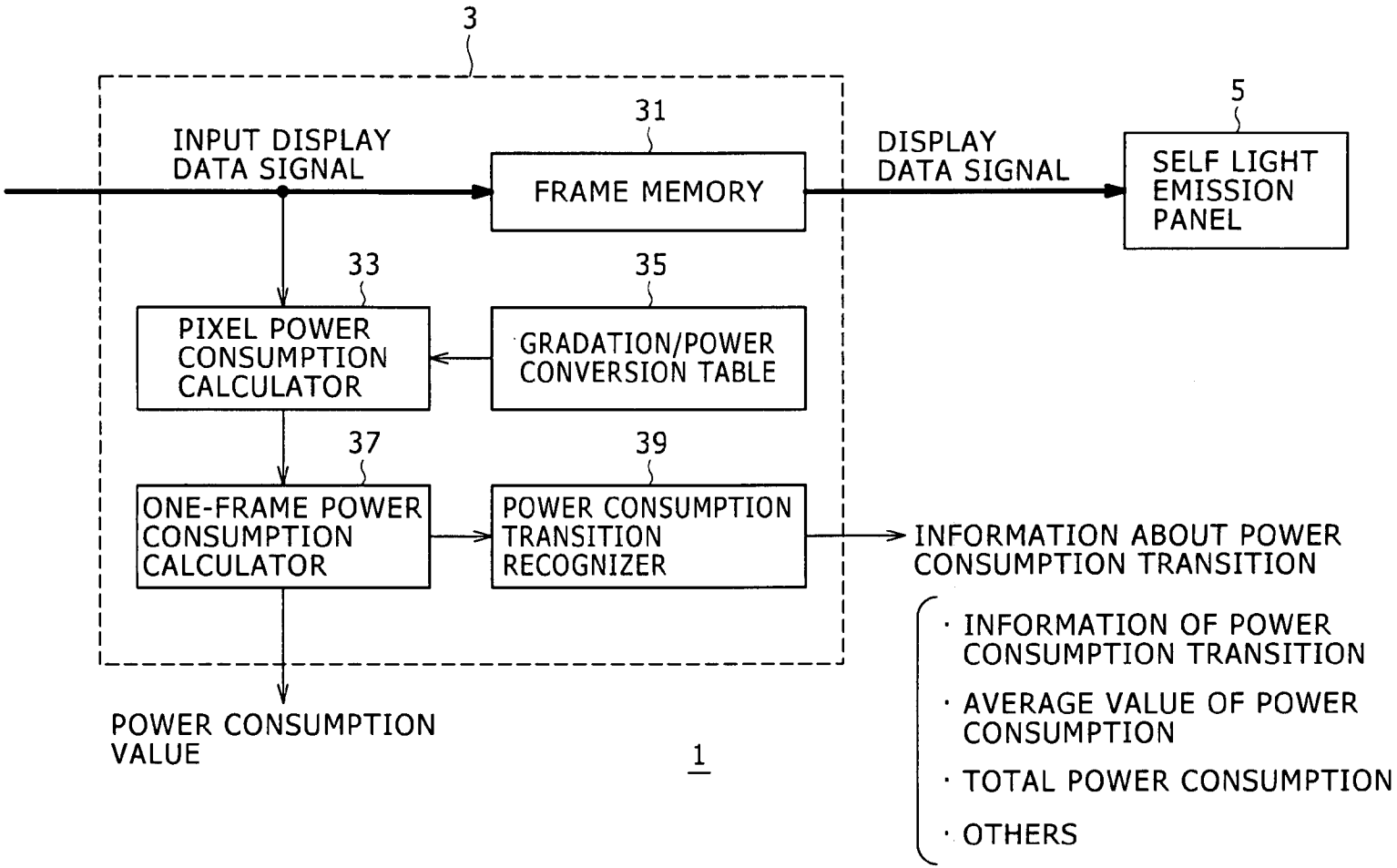
FIG. 1 is a block diagram showing a basic arrangement of a power consumption detecting device according to an embodiment of the present invention.

(A) Basic Arrangement 1:

FIG. 1 shows in block form a basic arrangement of a power consumption detecting device for detecting power consumption according to a fully digital process.

As shown in FIG. 1, a display device 1 includes a power consumption detecting device 3 and a self light emission panel 5. The self light emission panel 5 includes an organic EL display panel module.

The power consumption detecting device 3 includes a frame memory 31, a pixel power consumption calculator 33, a gradation/power conversion table 35, a one-frame power consumption calculator 37, and a power consumption transition recognizer 39.

The frame memory 31 includes a buffer memory for delaying the supply of an input display data signal (gradation value) to the self light emission panel 5. The frame memory 31 may delay the supply of the input display data signal by any desired time. If the light emission of the self light emission panel 5 is controlled based on the power consumption detected by the power consumption detecting device 3, then the frame memory 31 should delay the supply of the input display data signal by a period of time long enough to synchronize the light emission control with the image displayed by the display device 1.

Figures 2, 3:
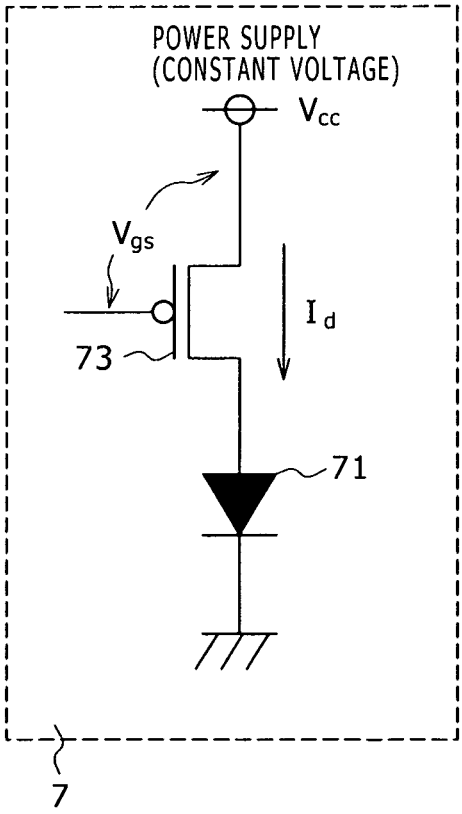
FIG. 2 is a diagram showing an example of a gradation/power conversion table.
FIG. 3 is a circuit diagram showing an example of a pixel circuit.

The pixel power consumption calculator 33 is a processing device for calculating the power consumption of each pixel based on the input display data signal (gradation value). A gradation value is converted into a power consumption value by the gradation/power conversion table 35. FIG. 2 shows an example of the gradation/power conversion table 35. In FIG. 2, the gradation/power conversion table 35 has eight-bit gradation values ranging from 0 to 255, 256 values in total.

FIG. 3 shows a general pixel circuit 7 for use in the organic EL display panel module as the self light emission panel 5. The pixel circuit 7 includes an organic EL element 71 and a drive transistor 73. The pixel circuit 7 corresponds to each of the pixels that make up the self light emission panel 5. As shown in FIG. 3, a drive current $I_d$ corresponding to a gradation value is determined by the drive transistor 73. Specifically, the drive current $I_d$ is determined depending on the gate-to-source voltage $V_{gs}$ of the drive transistor 73.

Figure 4:
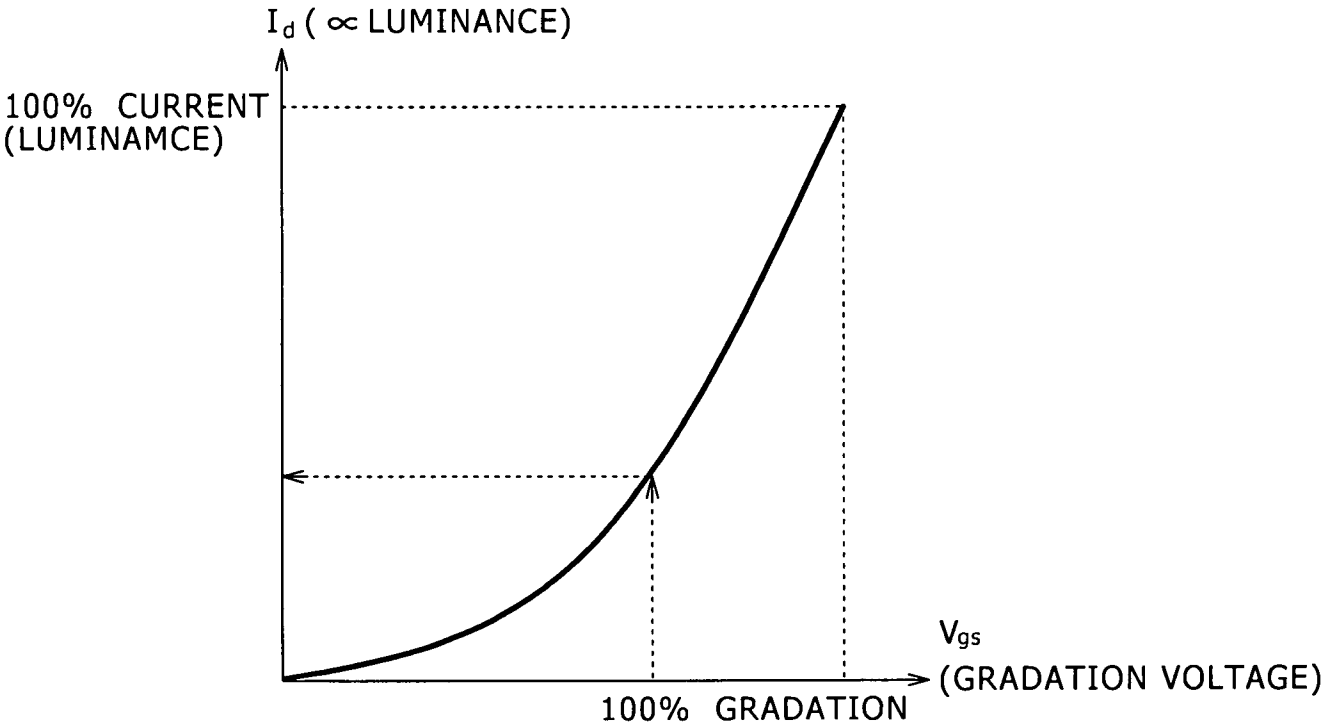
FIG. 4 is a diagram showing a $V_{gs}$-$I_d$ characteristic curve.

FIG. 4 shows a $V_{gs}$-$I_d$ characteristic curve of the drive transistor 73. The $V_{gs}$-$I_d$ characteristic curve may be calculated logically based on the design values or may be measured actually based on the self light emission panel 5.

In FIG. 4, a constant fixed power supply voltage $V_{cc}$ is applied to the drive transistor 73. Power consumption values $P_0$ through $P_{255}$ corresponding to the respective gradation values are given as the products of drive currents $I_d$ corresponding to the respective gradation values and the power supply voltage $V_{cc}$.

FIG. 5 shows an association between the gradation values and the power consumption values.

The value calculated by the above calculating formula represents the power consumption value of each pixel. The gradation/power conversion table 35 stores power consumption values P calculated by the above calculating formula in association with the respective gradation values.

The one-frame power consumption calculator 37 is a processing device for adding the calculated power consumption values P of the respective pixels of a frame, thereby to calculate a power consumption value for the engine screen, i.e., the entire frame.

The power consumption value calculated for the frame by the one-frame power consumption calculator 37 is output as digital data from the power consumption detecting device 3 and is also output to the power consumption transition recognizer 39.

The power consumption transition recognizer 39 is a processing device for generating information representative of a transition of power consumption required by the system of the display device 1. The information representative of the transition of power consumption includes, for example, a power consumption value, a rate of change of a power consumption value from a power consumption value calculated in the past, an average power consumption value (a power consumption value per unit time), and a total power consumption value (a cumulative power consumption value).

The processing sequence that is performed by the power consumption transition recognizer 39 differs depending on how the power consumption value per frame is to be used.

Details of the processing sequence will be described later. The power consumption detecting device 3 shown in FIG. 1 allows the power consumption of the self light emission panel 5 to be detected only according to a digital signal processing sequence. Therefore, there is no need for a feedback loop for an actual current that is detected. The accuracy with which to detect the power consumption is high because the power consumption detecting device 3 is free of noise and error caused by the detection of analog currents.

The power consumption detecting device 3 shown in FIG. 1 is capable of detecting electric power to be consumed by the display of an image on the self light emission panel 5 before the image is actually displayed on the self light emission panel 5. For example, the power consumption detecting device 3 can predict what power consumption fluctuation will occur in a next frame. Therefore, the power consumption detecting device 3 can perform any of various signal processing sequences with respect to the power consumption fluctuation.

Since power consumption can be detected in advance, the system of the display device 1 can have an extra period of processing time, which may be two frames or more. Using the extra period of processing time, it is possible to optimize any of various signal processing sequences including power consumption fluctuations over several frames ahead.

For example, according to a specific example, the power consumption predicting capability is effective to suppress an instantaneous current when the self light emission panel switches from a dark screen to a bright screen. If changes in power consumption are known over some frames ahead, then the rate of change of the luminance as well as the performance of the power supply circuit can be optimized.

(A-1) Applied System:

Representative examples of the use of the information representative of the transition of power consumption will be described below.

(1) EXAMPLE 1

A process of controlling an emission time ratio (duty ratio) of the self light emission panel 5 using the power consumption value of an entire frame calculated before the image is displayed, to control the peak luminance of the screen, will be described below with reference to FIG. 6.

Figure 6:
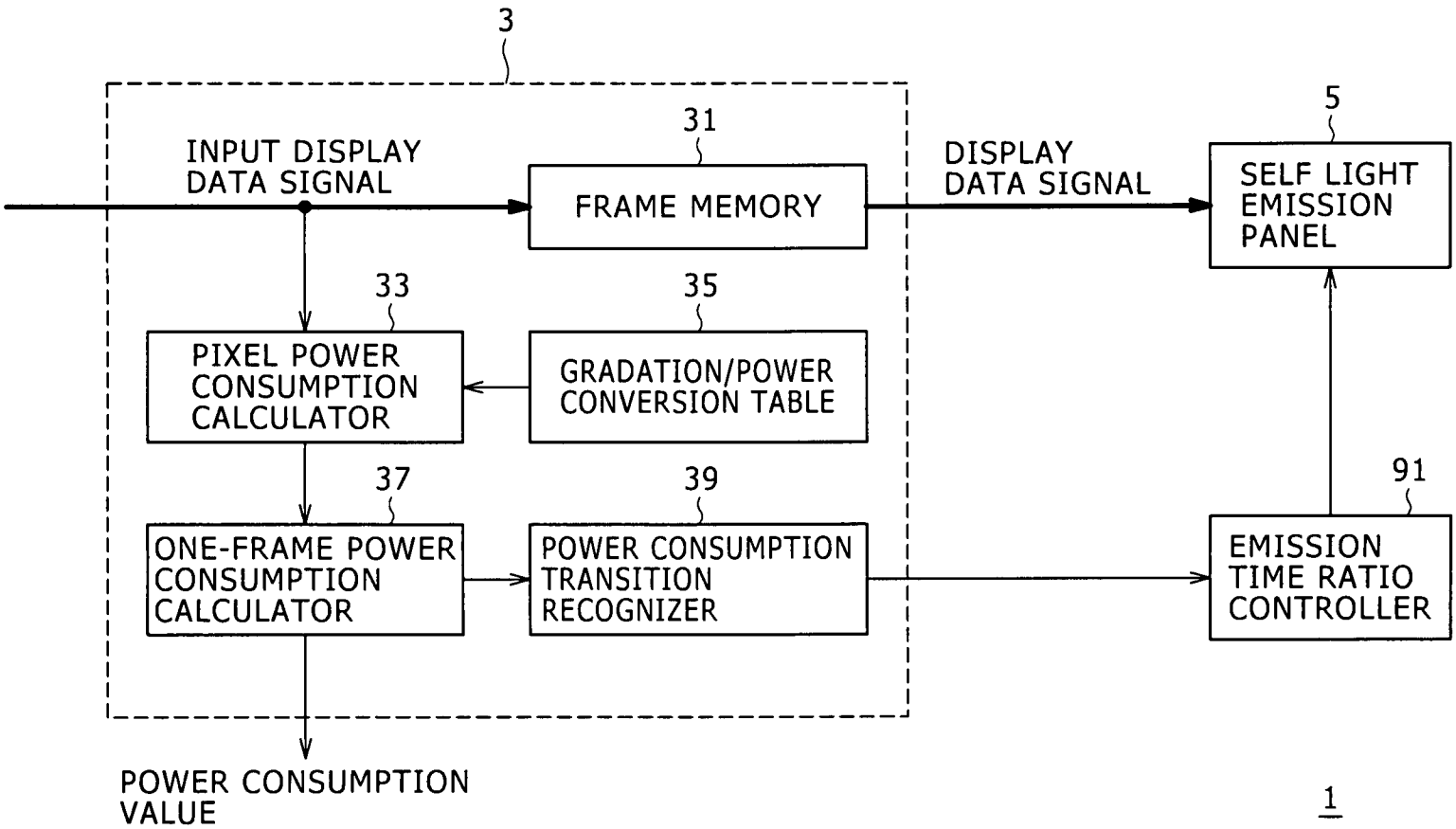
FIG. 6 is a block diagram showing an applied system.

FIG. 6 shows a display device 1 for controlling the peak luminance of a frame based on the calculated power consumption value which corresponds to the frame. In FIG. 6, the power consumption transition recognizer 39 operates as a peak luminance controller. Specifically, the power consumption transition recognizer 39 determines a change in the displayed image based on the transition of power consumption and supplies an emission time ratio controller 91 with a peak luminance control signal depending on the determined change.

For example, if the power consumption is continuously constant regardless of its magnitude, then the power consumption transition recognizer 39 judges that a still image is being input (displayed) and gives the emission time ratio controller 91 a control signal for progressively reducing the peak luminance over the entire screen, i.e., for progressively reducing the power consumption. This is because, even when the peak luminance of a still image is reduced, the degradation of the image quality is not perceived by the viewer.

The emission time ratio controller 91 generates an emission time ratio control signal based on the control signal from the power consumption transition recognizer 39 and supplies the emission time ratio control signal to the self light emission panel 5.

Figure 7:
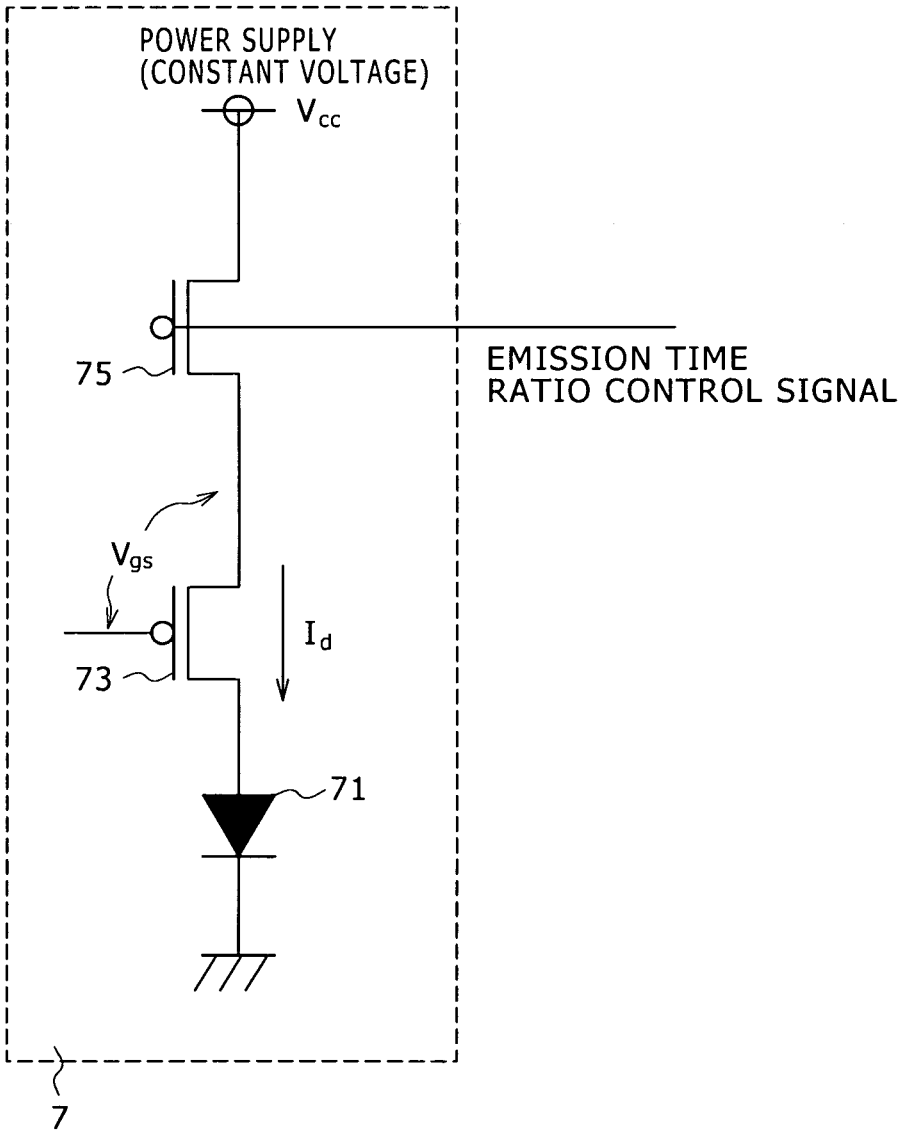
FIG. 7 is a circuit diagram showing an example of a pixel circuit whose emission time ratio can be controlled variably.

FIG. 7 shows an example of a pixel circuit whose emission time ratio can be controlled variably. Those parts of the pixel circuit shown in FIG. 7 which are identical to those shown in FIG. 3 are denoted by identical reference characters. The pixel circuit shown in FIG. 7 additionally has an emission time control transistor 75 connected in series to the drive transistor 73. The emission time ratio control signal from the emission time ratio controller 91 is applied to emission time control transistor 75. When the emission time control transistor 75 is turned on, the drive current $I_d$ depending on the gradation value flows through the organic EL element 71.

When the emission time control transistor 75 is turned off, the drive current $I_d$ stops being supplied to the organic EL element 71.

Figures 8A, 8B:
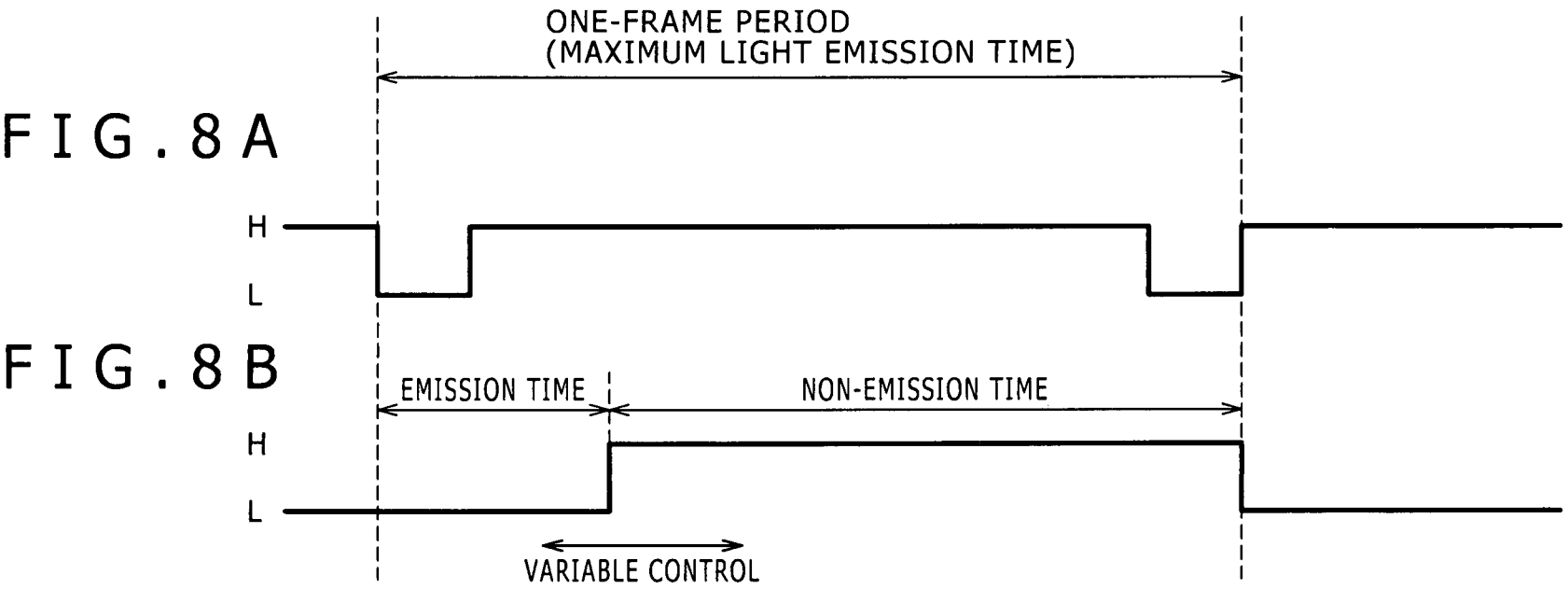
FIGS. 8A and 8B are diagrams showing an example of an emission time ratio control signal.

FIG. 8B shows an emission time ratio control signal by way of example. FIG. 8A shows the period of one frame. The maximum light emission period in one frame can be varied by varying the ratio of an on-state to an off-state, as shown in FIG. 8B.

(2) EXAMPLE 2

Figure 9:
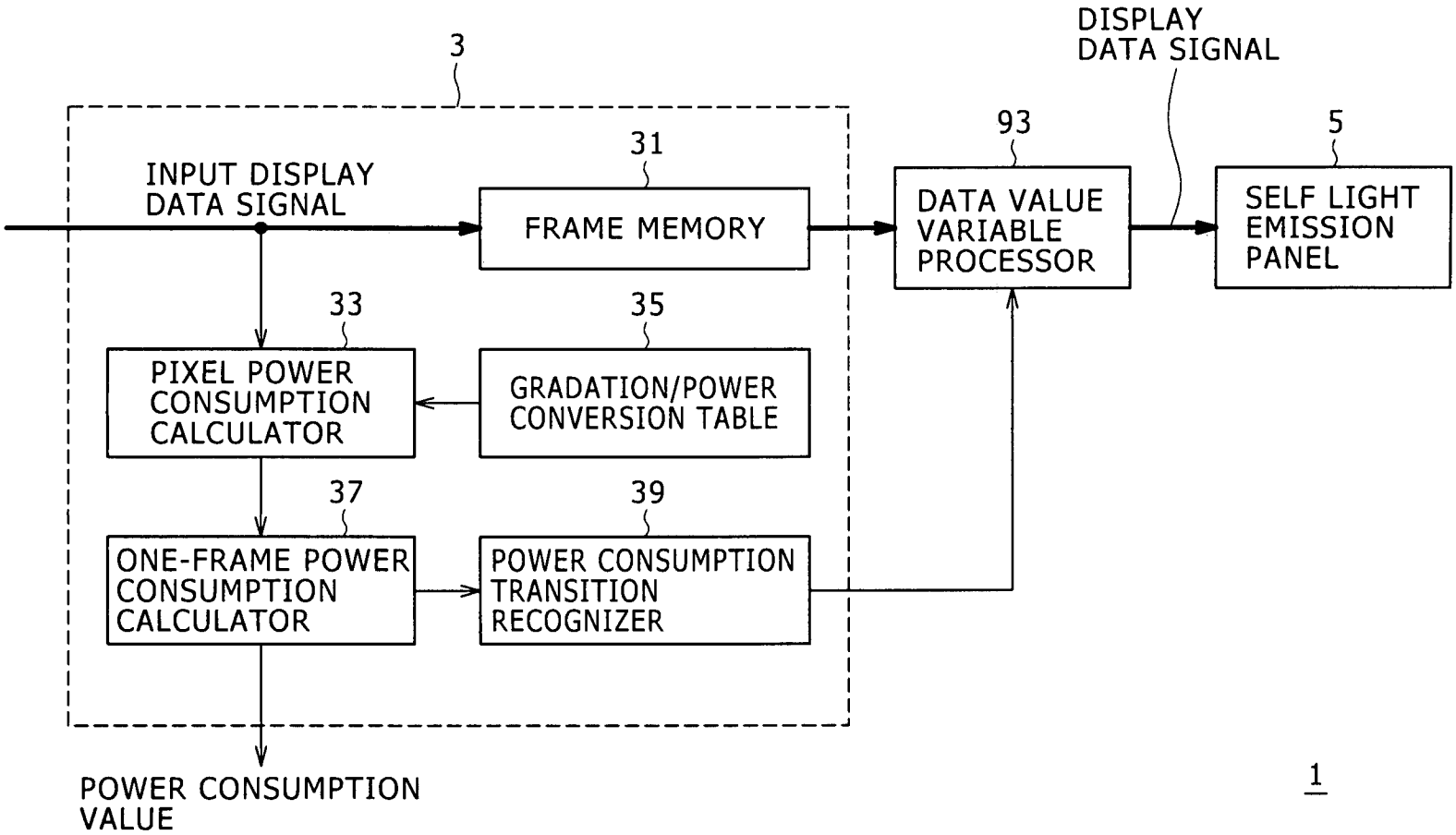
FIG. 9 is a block diagram showing another applied system.

A process of controlling a gradation level of the input display data signal using the power consumption value of an entire frame calculated before the image is displayed, to control the peak luminance of the screen, will be described below with reference to FIG. 9. FIG. 9 also shows a display device 1 for controlling the peak luminance of a frame based on the calculated power consumption value which corresponds to the frame.

In FIG. 9, the power consumption transition recognizer 39 operates as a data value controller. Specifically, the power consumption transition recognizer 39 determines a change in the displayed image based on the transition of power consumption and supplies a data value variable processor 93 with an entire luminance control signal depending on the determined change.

For example, if the power consumption is continuously constant regardless of its magnitude, then the power consumption transition recognizer 39 judges that a still image is being input (displayed) and gives the data value variable processor 93 a control signal for progressively reducing the peak luminance over the entire screen, i.e., for progressively reducing the power consumption.

The data value variable processor 93 uniformly increases or reduces the input display data signal (gradation value) based on the control signal from the power consumption transition recognizer 39, and supplies a display data signal representing the increased or reduced input display data signal to the self light emission panel 5. For example, each gradation value of the input display data signal is increased or reduced uniformly by the same value. Alternatively, each gradation value of the input display data signal is increased or reduced at a uniform ratio.

(3) EXAMPLE 3

A process of controlling a power supply current using the power consumption value of an entire frame calculated before the image is displayed, to suppress an abrupt change in the load, will be described below with reference to FIG. 10.

Figure 10:
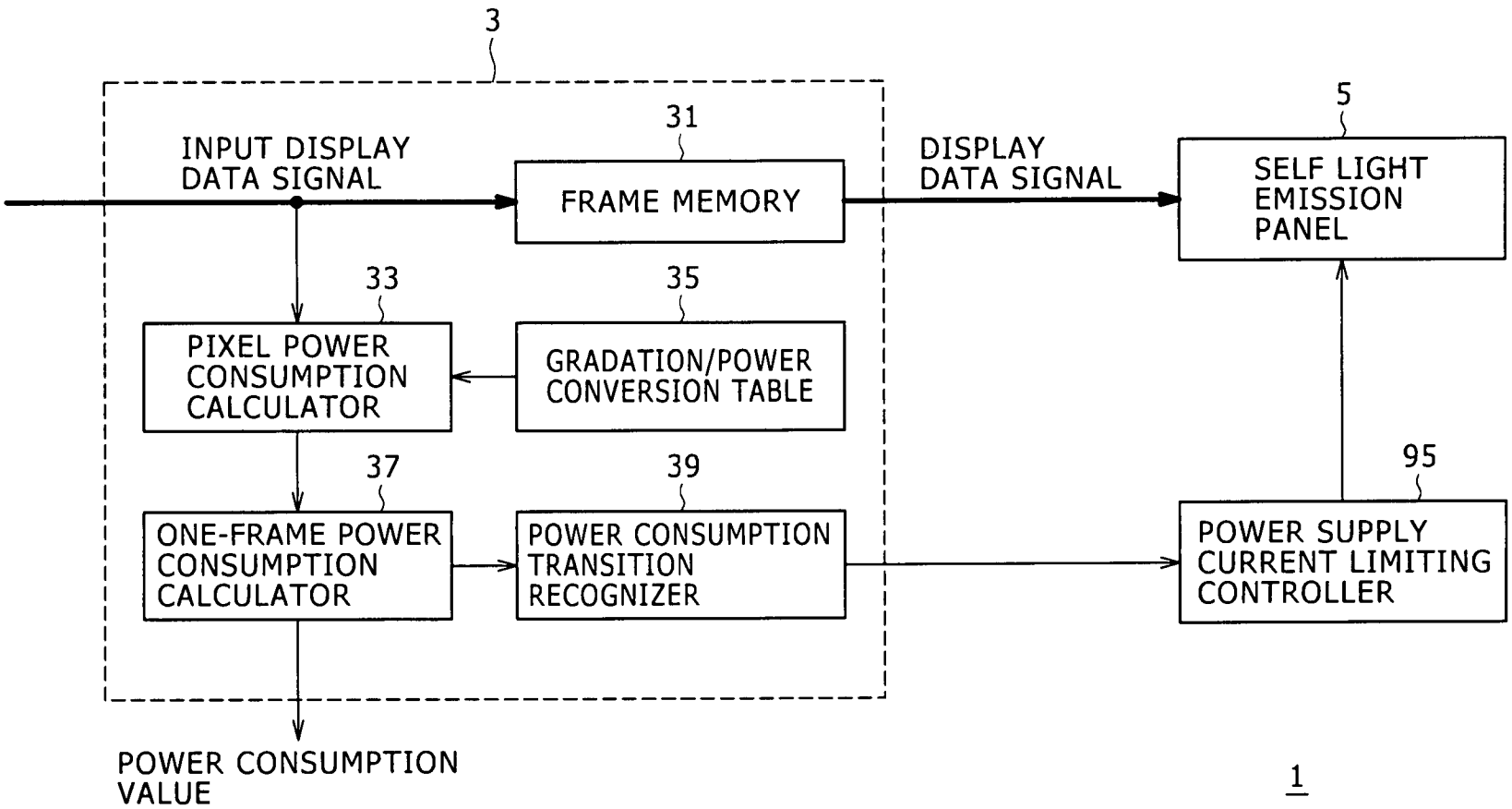
FIG. 10 is a block diagram showing still another applied system.

In FIG. 10, the power consumption transition recognizer 39 operates as a drive power supply controller. Specifically, the power consumption transition recognizer 39 detects an abrupt change in the displayed image based on the transition of power consumption and supplies a power supply current limiting controller 95 a control signal for limiting an abrupt change in the drive current depending on the detected change.

For example, based on the supplied control signal, the power supply current limiting controller 95 reduces the amount of current flowing in a current source of the power supply circuit to reduce the drive voltage of the organic EL element 71, thereby reducing the power consumption.

(4) EXAMPLE 4

A process of recognizing an amount of remaining battery energy using the power consumption value of an entire frame calculated before the image is displayed will be described below with reference to FIG. 11.

Figure 11:
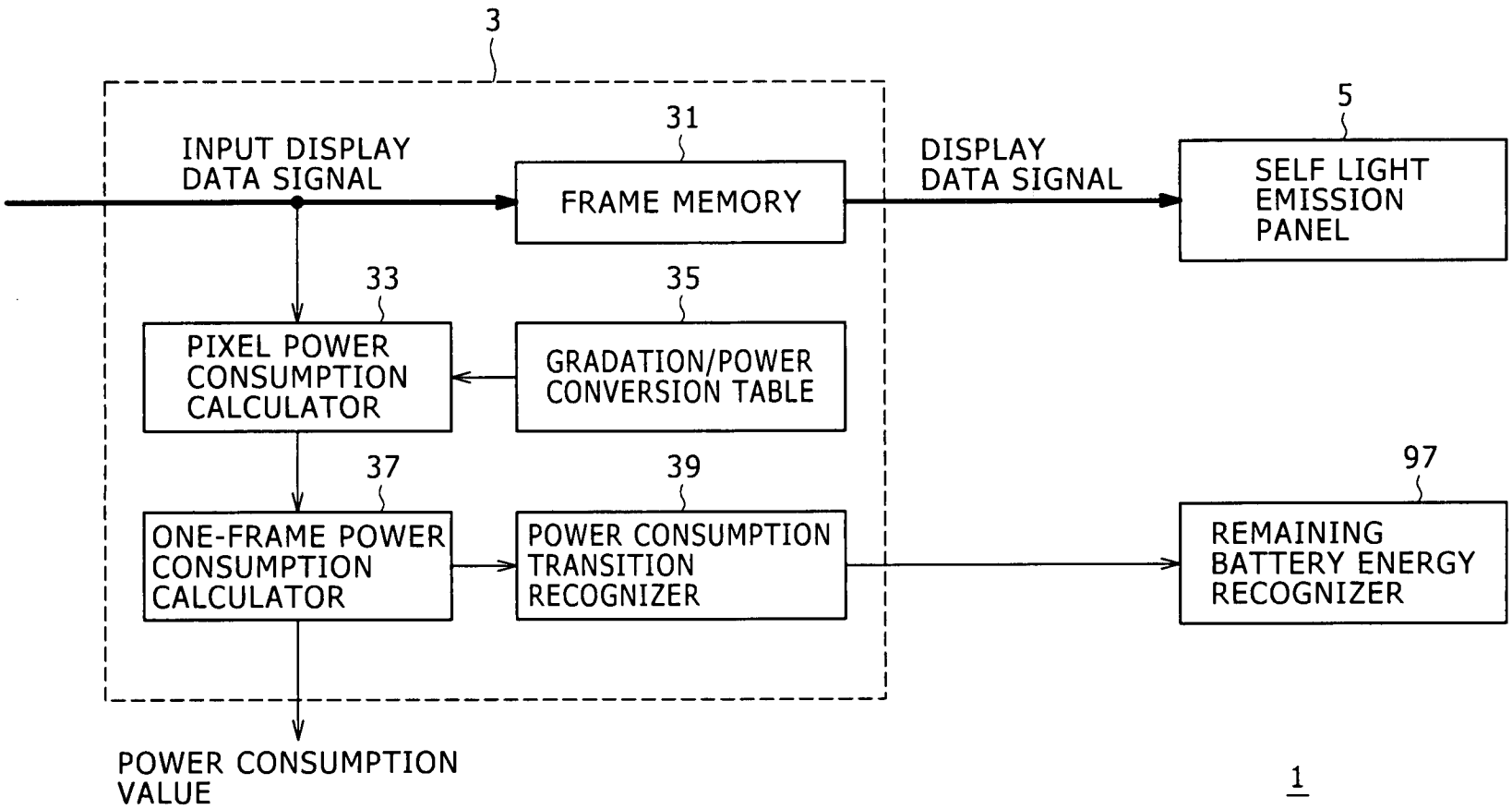
FIG. 11 is a block diagram showing yet another applied system.

In FIG. 11, the power consumption transition recognizer 39 operates as a total power consumption recognizer. Specifically, the power consumption transition recognizer 39 accumulates power consumption values calculated for respective frames to calculate the sum of electric power consumed in the past and gives the calculated total amount of power consumption to a remaining battery energy recognizer 97.

Since the total amount of power consumption can be calculated according to a fully digital process, the power consumption requisite to detect the total amount of power consumption is minimized, and the accuracy with which to predict a remaining amount of battery energy is increased.

Figure 12:
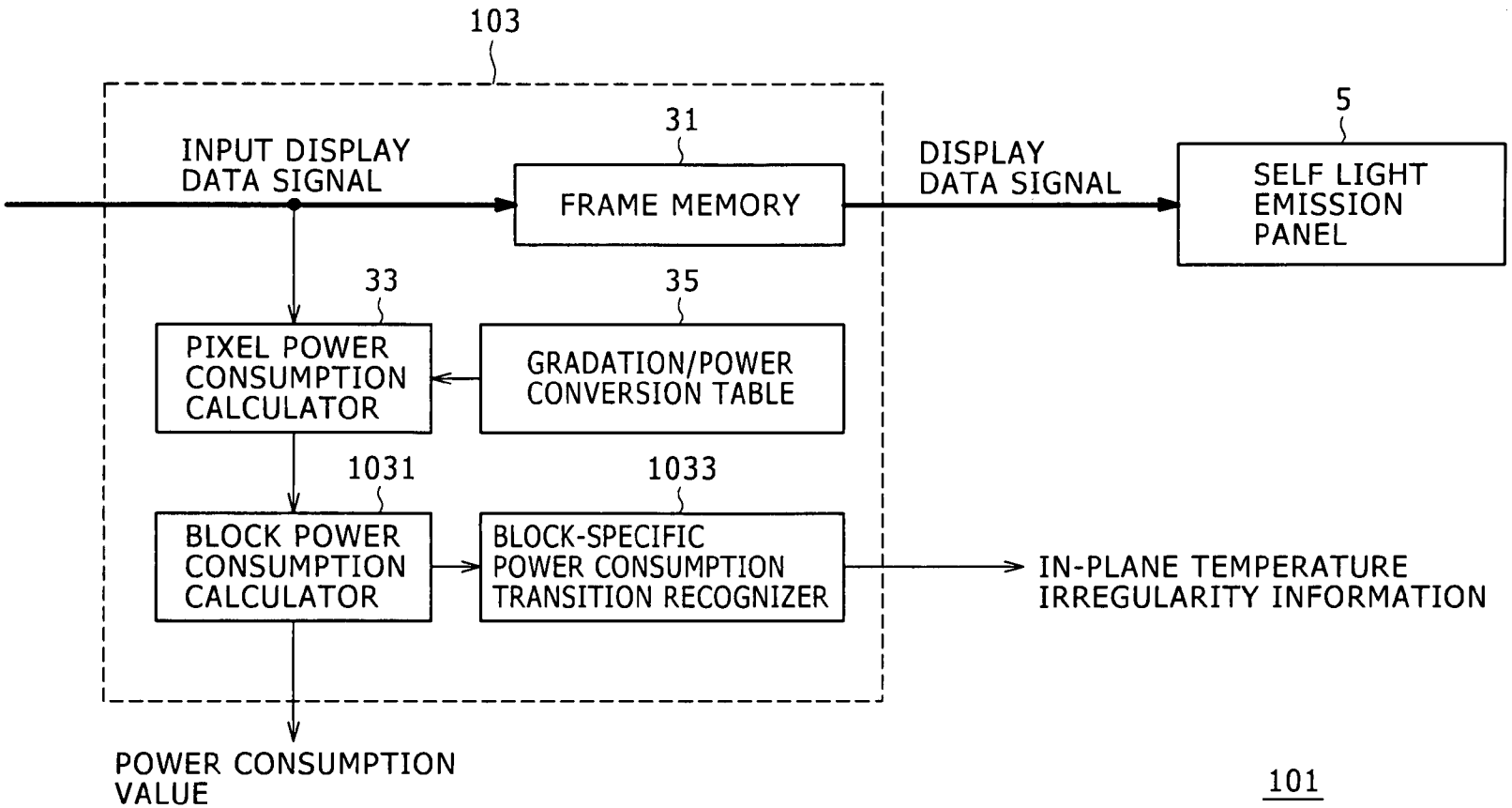
FIG. 12 is a block diagram showing another basic arrangement of another power consumption detecting device according to an embodiment of the present invention.

(B) Basic Arrangement 2:

FIG. 12 shows in block form another basic arrangement of a power consumption detecting device for detecting power consumption according to a fully digital process.

As shown in FIG. 12, a display device 101 includes a power consumption detecting device 103 and a self light emission panel 5.

The power consumption detecting device 103 includes a frame memory 31, a pixel power consumption calculator 33, a gradation/power conversion table 35, a block power consumption calculator 1031, and a block-specific power consumption transition recognizer 1033. Those parts of the power consumption detecting device 103 shown in FIG. 12 which are identical to those shown in FIG. 1 are denoted by identical reference characters. The power consumption detecting device 103 according to the basic arrangement 2 shown in FIG. 12 differs from the power consumption detecting device 3 according to the basic arrangement 1 shown in FIG. 1 with regard to the block power consumption calculator 1031 and the block-specific power consumption transition recognizer 1033.

The block power consumption calculator 1031 is a processing device for adding power consumption values P calculated for all the pixels in each of blocks, to calculate electric power values consumed by the respective blocks.

Figure 13:
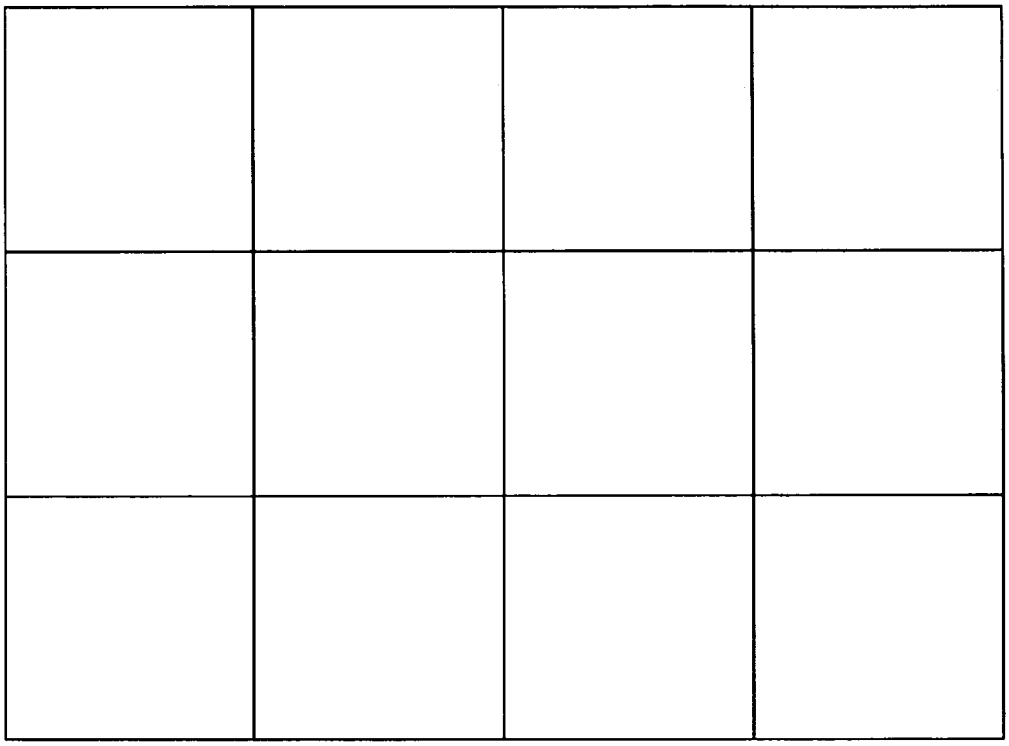
FIG. 13 is a diagram showing an example of the layout of blocks.

FIG. 13 shows an example of the layout of blocks. In FIG. 13, the screen of one frame is divided into 12 blocks arranged in three rows×four columns.

The block power consumption calculator 1031 calculates power consumption values of the respective 12 blocks.

The power consumption values calculated by the block power consumption calculator 1031 are output directly from the power consumption detecting device 103 and are also output to the block-specific power consumption transition recognizer 1033.

The block-specific power consumption transition recognizer 1033 is a processing device for generating information representative of the transition of the power consumption values specific to the blocks required by the system of the display device 101.

The information representative of the transition of the power consumption values includes, for example, a block distribution of the power consumption values, a rate of change of the power consumption value of each block from a power consumption value thereof calculated in the past, an average power consumption value of each block (a power consumption value per unit time of each block), a total power consumption value of each block (a cumulative power consumption value of each block), a temperature distribution of each block, and an estimated degradation in view of the temperature distribution.

The processing sequence that is performed by the block-specific power consumption transition recognizer 1033 differs depending on how the power consumption value per block is to be used.

Depending on the information representative of the transition of the power consumption values, the block-specific power consumption transition recognizer 1033 functions as a recognizer for recognizing a block distribution of the power consumption values, a recognizer for recognizing a rate of change of the power consumption value of each block, a recognizer for recognizing an average power consumption value of each block, a recognizer for recognizing a total power consumption value of each block, a recognizer for recognizing a temperature distribution of each block, and an estimator for estimating a degradation in view of the temperature distribution.

The power consumption detecting device 103 shown in FIG. 12 allows the electric power consumed when the input image data signal is displayed to be detected according to a fully digital signal processing sequence. Therefore, there is no need for a feedback loop for an actual current that is detected. The accuracy with which to detect power consumption is high because the power consumption detecting device 103 is free of noise and error caused by the detection of analog currents.

The power consumption detecting device 103 shown in FIG. 12 is capable of detecting electric power to be consumed by the display of an image on the self light emission panel 5 before the image is actually displayed on the self light emission panel 5. For example, the power consumption detecting device 103 can predict what power consumption fluctuation will occur in a next frame with respect to each block. Therefore, the power consumption detecting device 103 can perform any of various signal processing sequences with respect to the power consumption fluctuation.

Since power consumption can be detected in advance, the system of the display device 101 can have an extra period of processing time, which may be two frames or more. Using the extra period of processing time, it is possible to optimize any of various signal processing sequences including power consumption fluctuations over several frames ahead.

(C) Other Arrangements:

(a) In the above arrangements, an organic EL display panel has been illustrated as the self light emission display device. However, the present invention is applicable to other self light emission display devices including, for example, a field emission display (FED), an inorganic EL display panel, an LED panel, and a plasma display panel (PDP).

(b) In the above arrangements, the power consumption detecting devices 3, 103 incorporated in the display devices 1, 101 have been illustrated.

However, the power consumption detecting devices 3, 103 may be incorporated as part of an image processor including a display device. For example, the power consumption detecting devices 3, 103 may be incorporated in an image capturing device such as a video camera, a digital camera, a video or digital camera combined with a recorder, an information processing terminal such as a portable computer, a cellular phone unit, a portable game console, a personal digital assistant, and a game machine.

(c) In the above arrangements, the power consumption detecting devices 3, 103 incorporated in the display devices 1, 101 have been illustrated.

However, the power consumption detecting devices 3, 103 may be incorporated in an image processor for supplying an input display data signal to a display device or an image processor.

(d) In the above arrangements, the functions of the power consumption detecting devices 3, 103 have been described. These functions of the power consumption detecting devices 3, 103 may be hardware- or software-implemented.

Though the functions of the power consumption detecting devices 3, 103 may be fully hardware- or software-implemented, they may be partially hardware- or software-implemented, i.e., they may be a combination of hardware- and software-implemented functions.

(e) The above arrangements may be modified without the scope of the present invention. Various modifications and applications created or combined based on the above description fall within the scope of the present invention.

Although certain preferred embodiments of the present invention have been shown and described in detail, it should be understood that various changes and modifications may be made therein without departing from the scope of the appended claims.

What is claimed is:

1. A self light emission display device comprising:

a buffer memory configured to delay the supply of pixel data to a self light emission panel;

a lookup table configured to store all gradation values corresponding to a variable range of the pixel data and electric power values to be consumed for light emission respectively at the gradation values, in association with each other;

a power consumption calculator configured to add respective power consumption values of all pixels of a frame which are determined by referring to said lookup table to calculate a power consumption value of the frame; and a power consumption transition recognizer configured to generate information representative of a transition of the power consumption value of the frame, wherein said information representative of the transition of the power consumption value of the frame includes the power consumption value, a rate of change of the power consumption value, an average power consumption value, and a total power consumption value.

2. The self light emission display device according to claim 1, further comprising:

a peak luminance controller configured to vary a peak luminance of the frame based on the calculated power consumption value.

3. The self light emission display device according to claim 1, further comprising:

a data value variable controller configured to control pixel data values to vary a peak luminance of the frame based on the calculated power consumption value.

4. The self light emission display device according to claim 1, further comprising:

a drive power supply controller configured to control a drive power supply to predict an abrupt change in a power supply load based on the calculated power consumption value and to suppress an abrupt load fluctuation.

5. The self light emission display device according to claim 1, further comprising:

a remaining battery energy recognizer configured to calculate a remaining amount of battery energy based on the calculated power consumption value.

6. A self light emission display device comprising:

a buffer memory configured to delay the supply of pixel data to a self light emission panel;

a lookup table configured to store all gradation values corresponding to a variable range of the pixel data and electric power values to be consumed for light emission respectively at the gradation values, in association with each other;

a power consumption calculator configured to add respective power consumption values of all pixels of a frame which are determined by referring to said lookup table in each of preset blocks to calculate respective power consumption values of the blocks; and a power consumption transition recognizer configured to generate information representative of a transition of the power consumption value of the frame, wherein said information representative of the transition of the power consumption value of the frame includes the power consumption value, a rate of change of the power consumption value, an average power consumption value, and a total power consumption value.

7. The self light emission display device according to claim 6, further comprising:

a temperature distribution recognizer configured to recognize a temperature distribution in a display surface of the self light emission panel, based on the calculated power consumption values of the blocks.

8. A power consumption detecting device comprising:

a lookup table configured to store all gradation values corresponding to a variable range of pixel data and electric power values to be consumed by a self light emission device for light emission respectively at the gradation values, in association with each other;

a power consumption calculator configured to add respective power consumption values, corresponding to the pixel data, of a frame which are determined by referring to said lookup table to calculate a power consumption value of the frame; and a power consumption transition recognizer configured to generate information representative of a transition of the power consumption value of the frame, wherein said information representative of the transition of the power consumption value of the frame includes the power consumption value, a rate of change of the power consumption value, an average power consumption value, and a total power consumption value.

9. A power consumption detecting device comprising:

a lookup table configured to store all gradation values corresponding to a variable range of pixel data and electric power values to be consumed by a self light emission device for light emission respectively at the gradation values, in association with each other;

a power consumption calculator configured to add respective power consumption values, corresponding to the pixel data, of a block which are determined by referring to said lookup table in each of preset blocks to calculate respective power consumption values of the blocks; and a power consumption transition recognizer configured to generate information representative of a transition of the power consumption value of the block, wherein said information representative of the transition of the power consumption value of the frame includes the power consumption value, a rate of change of the power consumption value, an average power consumption value, and a total power consumption value.

10. A non-transitory computer readable medium having program code stored thereon, the program code being executable by a computer to perform operations comprising:

referring to a lookup table for storing all gradation values corresponding to a variable range of pixel data and electric power values to be consumed by a self light emission device for light emission respectively at the gradation values, in association with each other, to determine respective electric power values, corresponding to the pixel data, consumed by said self light emission device;

adding the electric power values in each frame to calculate a power consumption value of the frame; and generating information representative of a transition of the power consumption value of the frame, wherein said information representative of the transition of the power consumption value of the frame includes the power consumption value, a rate of change of the power consumption value, an average power consumption value, and a total power consumption value.

11. A non-transitory computer readable medium having program code stored thereon, the program code being executable by a computer to perform operations comprising:

referring to a lookup table for storing all gradation values corresponding to a variable range of pixel data and electric power values to be consumed by a self light emission device for light emission respectively at the gradation values, in association with each other, to determine respective electric power values, corresponding to the pixel data, consumed by said self light emission device;

adding the electric power values in each block to calculate a power consumption value of the block; and generating information representative of a transition of the power consumption value of the frame, wherein said information representative of the transition of the power consumption value of the frame includes the power consumption value, a rate of change of the power consumption value, an average power consumption value, and a total power consumption value.

12. The power consumption detecting device according to claim 8, further comprising:

a peak luminance controller configured to vary a peak luminance of the frame based on the calculated power consumption value.

13. The power consumption detecting device according to claim 8, further comprising:

a data value variable controller configured to control pixel data values to vary a peak luminance of the frame based on the calculated power consumption value.

14. The power consumption detecting device according to claim 8, further comprising:

a drive power supply controller configured to control a drive power supply to predict an abrupt change in a power supply load based on the calculated power consumption value and to suppress an abrupt load fluctuation.

15. The power consumption detecting device according to claim 8, further comprising:

a remaining battery energy recognizer configured to calculate a remaining amount of battery energy based on the calculated power consumption value.

16. The power consumption detecting device according to claim 9, further comprising:

a peak luminance controller configured to vary a peak luminance of the block based on the calculated power consumption value.

17. The power consumption detecting device according to claim 9, further comprising:

a data value variable controller configured to control pixel data values to vary a peak luminance of the block based on the calculated power consumption value.

* * * * *